US011578528B2

(12) United States Patent
Anderson, III et al.

(10) Patent No.: US 11,578,528 B2
(45) Date of Patent: Feb. 14, 2023

(54) SILL SYSTEMS FOR SLIDING FENESTRATION UNITS

(71) Applicant: Pella Corporation, Pella, IA (US)

(72) Inventors: Howard C. Anderson, III, Tracy, IA (US); Andy Breuer, Newton, IA (US); Andrew Morse, Altoona, IA (US); Joseph A. Ritzert, Pella, IA (US); Paul D. Schroder, Pella, IA (US); Jaden P. Vos, Pella, IA (US)

( * ) Notice: Subject to any disclaimer, the term of this patent is extended or adjusted under 35 U.S.C. 154(b) by 0 days.

(21) Appl. No.: 16/738,705

(22) Filed: Jan. 9, 2020

(65) Prior Publication Data

US 2020/0224486 A1 Jul. 16, 2020

Related U.S. Application Data

(60) Provisional application No. 62/791,447, filed on Jan. 11, 2019.

(51) Int. Cl.
*E06B 1/70* (2006.01)
*E06B 3/26* (2006.01)

(52) U.S. Cl.
CPC ..... *E06B 1/702* (2013.01); *E06B 3/26* (2013.01)

(58) Field of Classification Search
CPC . E06B 1/702; E06B 3/26; E06B 1/705; E06B 3/4609; E06B 7/14
See application file for complete search history.

(56) References Cited

U.S. PATENT DOCUMENTS 3,145,433 A * 8/1964 Jones ..... E06B 3/44 49/414
3,584,417 A 6/1971 Gatton et al.
3,858,375 A 1/1975 Silvernail
4,156,988 A 6/1979 Grover et al.
4,219,971 A * 9/1980 Mauroner ..... E05D 15/08 49/372
4,267,673 A * 5/1981 Coulston ..... E06B 1/325 428/57
4,310,991 A 1/1982 Seely
4,532,743 A 8/1985 Miller et al.
4,813,183 A 3/1989 Jordal
5,044,121 A 9/1991 Harbom et al.
5,379,824 A * 1/1995 Carvalho ..... E06B 3/2605 160/44
5,414,962 A 5/1995 Forbis et al.
5,596,851 A 1/1997 Ting
5,671,566 A * 9/1997 Tix ..... E05D 13/1207 16/197
5,673,517 A 10/1997 Stanclift
5,870,859 A 2/1999 Kitada
6,305,126 B1 * 10/2001 Hendrickson ..... E05G 1/00 49/415
6,883,279 B2 4/2005 Fukuro et al.
7,134,247 B2 11/2006 Ting
7,296,381 B1 * 11/2007 McCabe ..... E06B 3/44 49/176

(Continued)

*Primary Examiner* — Jessie T Fonseca
(74) *Attorney, Agent, or Firm* — Faegre Drinker Biddle & Reath; Johnathon Webb; Victor Jonas

(57) ABSTRACT

Various aspects of the disclosure relate to modular sill systems for sliding panel doors and windows, collectively "sliding fenestration units." In various examples, modular sill systems include multiple separate and distinct base components that provide tracks on which one or more panels are able to slide.

23 Claims, 12 Drawing Sheets

(56) References Cited

U.S. PATENT DOCUMENTS

| | | | | |
|---|---|---|---|---|
| 8,276,320 | B2 | 10/2012 | Erbrect et al. | |
| 9,175,471 | B2 | 11/2015 | Ting | |
| 9,371,682 | B2 | 6/2016 | Van Camp et al. | |
| 9,388,626 | B2 | 7/2016 | Gilbert et al. | |
| 9,394,741 | B2 * | 7/2016 | Phandanouvong | E06B 3/44 |
| 9,556,668 | B2 | 1/2017 | Kadavy et al. | |
| 9,856,691 | B2 | 1/2018 | Nielsen et al. | |
| 2003/0221381 | A1 | 12/2003 | Ting | |
| 2005/0039864 | A1 | 2/2005 | Arcamonte et al. | |
| 2005/0066581 | A1 * | 3/2005 | Rhode | E06B 7/2316 49/414 |
| 2006/0026913 | A1 * | 2/2006 | Turner | E06B 3/4609 52/204.5 |
| 2006/0254151 | A1 * | 11/2006 | Curtis | E06B 3/44 49/414 |
| 2010/0058683 | A1 | 3/2010 | Bushberger | |
| 2012/0005975 | A1 * | 1/2012 | Kim | E06B 7/26 52/209 |
| 2012/0023825 | A1 | 2/2012 | Labrecque | |
| 2013/0097934 | A1 | 4/2013 | Cook | |
| 2019/0003227 | A1 * | 1/2019 | McCoy | E06B 1/702 |

* cited by examiner

SILL SYSTEMS FOR SLIDING FENESTRATION UNITS

CROSS REFERENCE TO RELATED APPLICATION

This application claims the benefit of Provisional Application No. 62/791,447, filed Jan. 11, 2019, which is herein incorporated by reference in its entirety.

TECHNICAL FIELD

Various aspects of the instant disclosure relate to sill designs and associated methods of manufacture for sliding door and window fenestration units.

BACKGROUND

Sliding door or window fenestration units may have more than one sliding, or venting panel. Typically, such fenestration units incorporate multiple tracks upon which the sliding panels travel. Often times, fenestration units with multiple panels are manufactured as custom units for a particular opening. Improvements in the ability to manufacture units with multiple, sliding panels in an effective manner, with proper performance characteristics (e.g., water performance), remain to be realized.

SUMMARY

Various aspects of the disclosure relate to modular sill systems for sliding panel doors and windows, collectively "sliding fenestration units." In various examples, modular sill systems include multiple separate and distinct base components that provide tracks on which one or more panels are able to slide.

According to one example ("Example 1"), a modular sill system for multiple sliding panels includes a base member having a first end and a second end; a first sill frame element affixed to the base member; a second sill frame element, distinct from first sill frame element, affixed to the base member; a support member extending from the base member and arranged between the first sill frame element and the second sill frame element; and at least one cover component coupled to the first sill frame element and the second sill frame element that is configured to conceal a space between the first sill frame element and the second sill frame element.

According to another example ("Example 2") further to Example 1, the system further comprises an adhesive tape adhering the first sill frame element to the base member.

According to another example ("Example 3") further to Example 1, a top surface of the base member is substantially planar.

According to another example ("Example 4") further to Example 1, the base member includes stainless steel material.

According to another example ("Example 5") further to Example 1, the at least one cover component is releasably coupled to the first sill frame element.

According to another example ("Example 6") further to Example 5, the at least one cover component and the first sill frame element are snap-fit together.

According to another example ("Example 7") further to Example 1, the at least one cover component includes a first cover component coupled to the first sill frame element, a second cover component coupled to the second sill frame element, and a third cover component coupled to the first sill frame element and the second sill frame element.

According to another example ("Example 8") further to Example 7, the first sill frame element forms a first track configured to receive a first panel and the second sill frame element forms a second track configured to receive a second panel, and the first cover component, the second cover component, and the third cover component form a substantially planar surface with gaps for the first track and the second track.

According to another example ("Example 9") further to Example 8, wherein at least one of the first cover component and the second cover component includes an angled portion forming a ramp feature.

According to another example ("Example 10") a fenestration unit includes a modular sill system for multiple sliding panels, the fenestration unit further including a first sliding panel and a second sliding panel; a base member having a first end and a second end; a first sill frame element affixed to the base member and forming a track upon which the first sliding panel slides; a second sill frame element, distinct from first sill frame element, affixed to the base member and forming a track upon which the second sliding panel slides; a cover component releasably coupled to the first sill frame element and the second sill frame element to cover a space between the first sill frame element, the second sill frame element and the base member.

According to another example ("Example 11") further to Example 10, the modular sill system includes one or more apertures adjacent the track formed by the first sill frame element, the one or more apertures providing an air pathway into the space between the first sill frame element, the second sill frame element and the base member.

According to another example ("Example 12") further to Example 10, the system further comprises a sill plug arranged in the space between the first sill frame element, the second sill frame element and the base member.

According to another example ("Example 13") a method of manufacturing a modular sill system for multiple sliding panels includes affixing a first sill frame element to a base member; affixing a second sill frame element, distinct from first sill frame element, to the base member; arranging a support member in contact with the base member and between the first sill frame element and the second sill frame element; and coupling a cover component to the first sill frame element and the second sill frame element.

According to another example ("Example 14") further to Example 13, affixing the first sill frame element to the base member includes adhering the first sill frame element to the base member using an adhesive tape on the base member.

According to another example ("Example 15") further to Example 13, affixing the second sill frame element to the base member includes adhering the second sill frame element to the base member using an adhesive tape on the base member.

While multiple inventive examples are specifically disclosed, various modifications and combinations of features from those examples will become apparent to those skilled in the art from the following detailed description. Accordingly, the disclosed examples are meant to be regarded as illustrative in nature and not restrictive.

BRIEF DESCRIPTION OF THE DRAWINGS

FIGS. 11*a* to 12 shows example connections between sections of a modular sill systems for multiple sliding panels, according to some examples.

Figure 1:
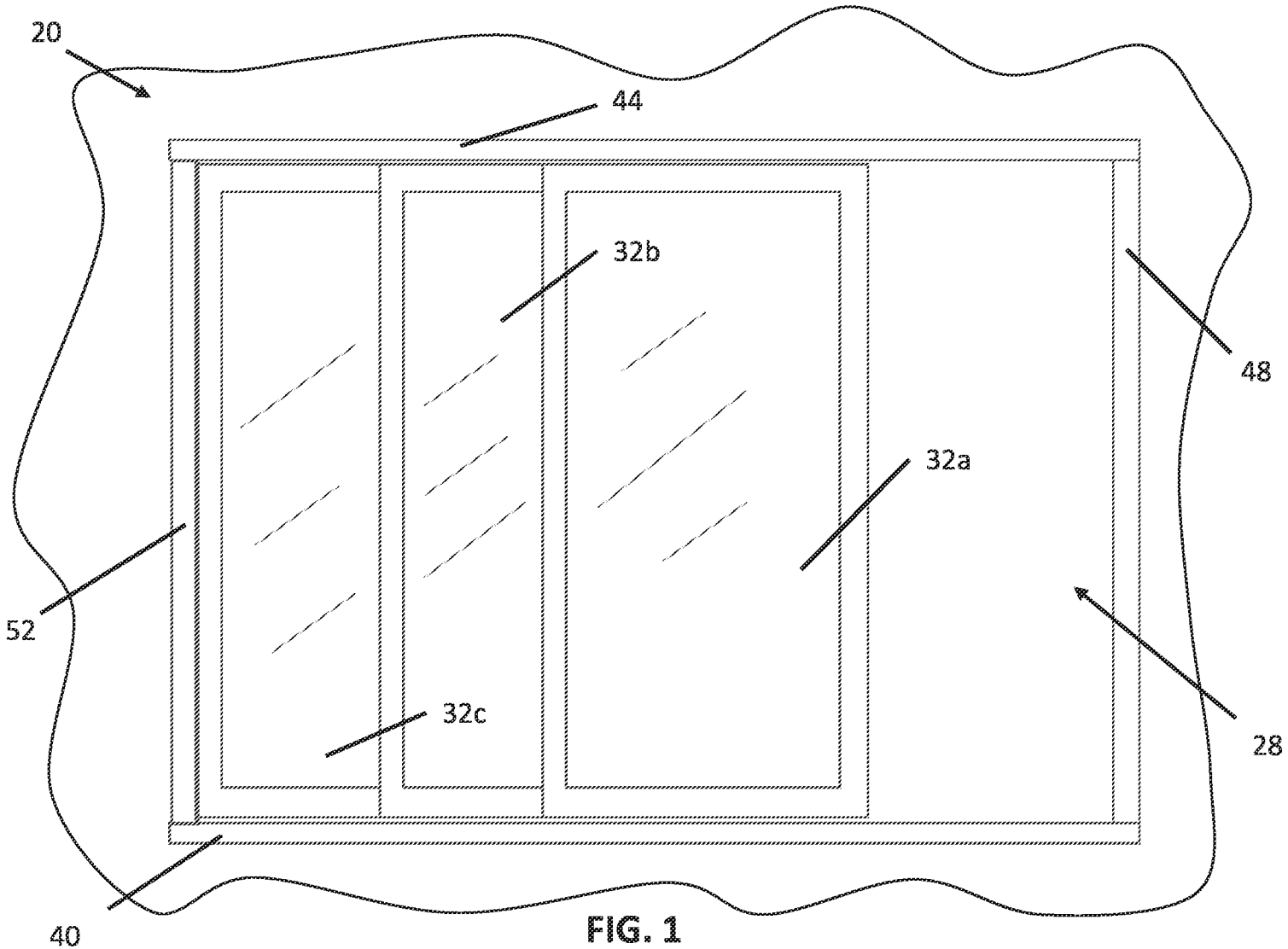
FIG. 1 shows a fenestration unit, according to some examples.

While the disclosure is amenable to various modifications and alternative forms, specific embodiments have been shown by way of example in the drawings and are described in detail below. The disclosure, however, is not limited to the particular embodiments described. On the contrary, the disclosure is intended to cover all modifications, equivalents, and alternatives falling within the scope of the disclosure as defined by the appended claims.

DETAILED DESCRIPTION

Various aspects of the present disclosure are directed toward modular sill systems for sliding panel doors and windows, collectively "sliding fenestration units." In various examples, modular sill systems include multiple separate and distinct base components that provide tracks on which one or more panels are able to slide. The modular sill system employs separate and distinct base components, as compared to monolithic sill system. The base components may be extruded, molded or otherwise formed as separate, distinct parts that are later assembled to facilitate custom manufacturing of a modular sill system configured to support a desired number of panels. The base components can be separately extruded, cast, molded, or otherwise formed such that any number of the base components can be arranged together to support any number of panels as desired.

FIG. 1 shows a fenestration unit 20 employing a modular sill system, according to some examples. The fenestration unit 20 includes a frame 24 defining a frame opening 28, and one or more panels 32 supported by the frame 24 and received in the frame opening 28. The frame 24 includes a modular sill system 40, a head member 44, a first jamb member 48, and a second jamb member 52. In various embodiments, the fenestration unit 20 defines a boundary between an interior space and an exterior space of a building structure. The one or more panels 32 is shown including a first panel 32*a*, a second panel 32*b*, and a third panel 32*c*. Although three panels are shown, any number of panels, including a single panel or a plurality of panels are contemplated. The modular sill system 40 includes tracks for one or more of the panel(s) 32 as explained in further detail below.

Figure 2:
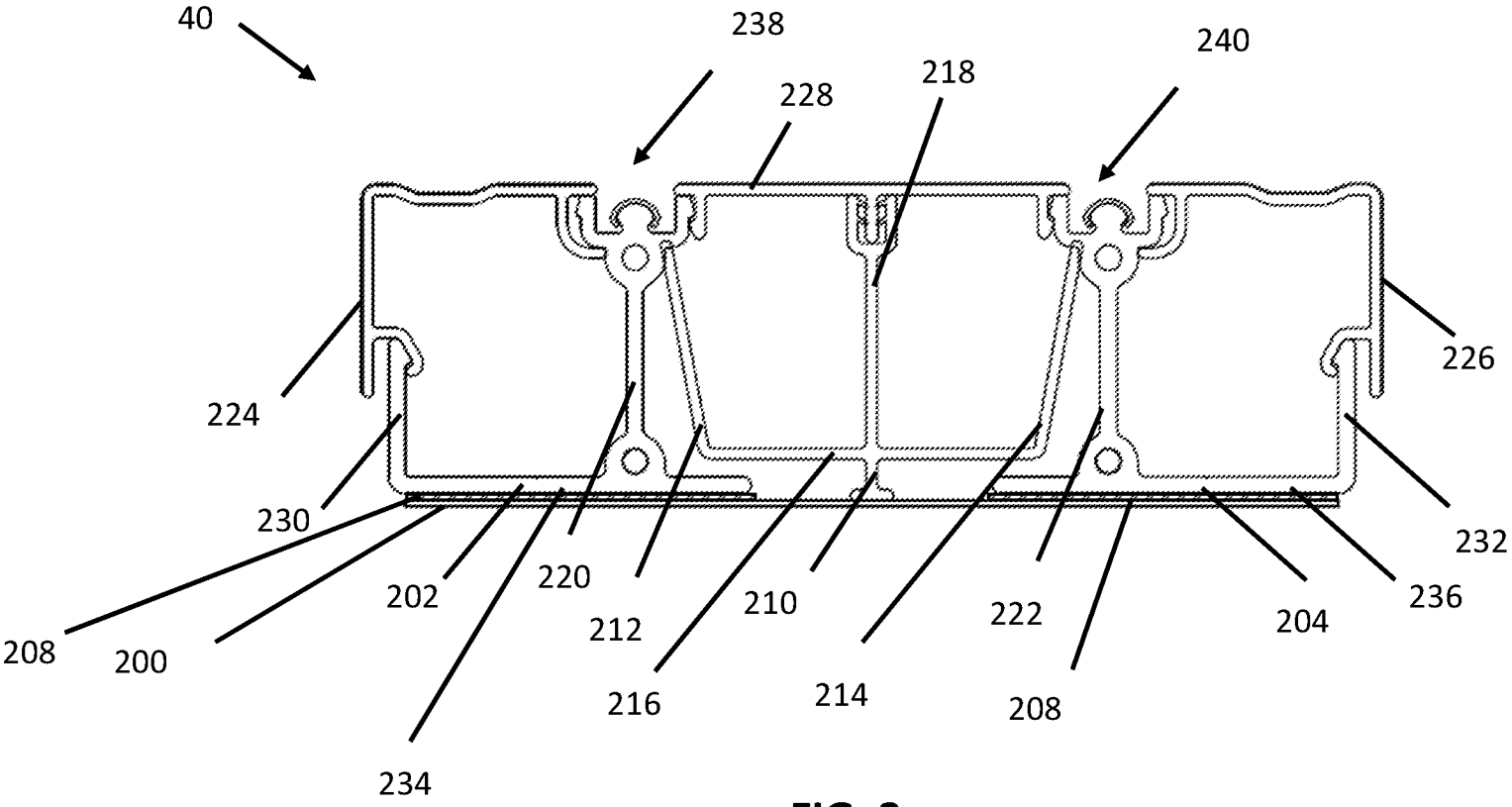
FIG. 2 shows a modular sill system for multiple sliding panels, according to some examples.

FIG. 2 shows a cross-sectional view of the modular sill system 40 for multiple sliding panels, according to some examples. As shown, the modular sill system 40 includes a base member 200 having a first end and second end, a first sill frame element 202 affixed to the base member 200 that extends between the first end and the second end of the base member 200, and a second sill frame element 204 affixed to the base member 200 that extends between the first end and the second end of the base member 200. As shown in FIG. 2, the first sill frame element 202 and the second sill frame element 204 are separate and distinct from one another, as well as being distinct from the base member 200. As compared to systems that include sill tracks that are extruded, molded or otherwise formed monolithically with a base member, the first sill frame element 202 and the second sill frame element 204 provide sill tracks that are formed as separate and distinct components from one another and the base member 200 and are subsequently affixed to the base member 200 as part of an assembly process.

Figure 4:
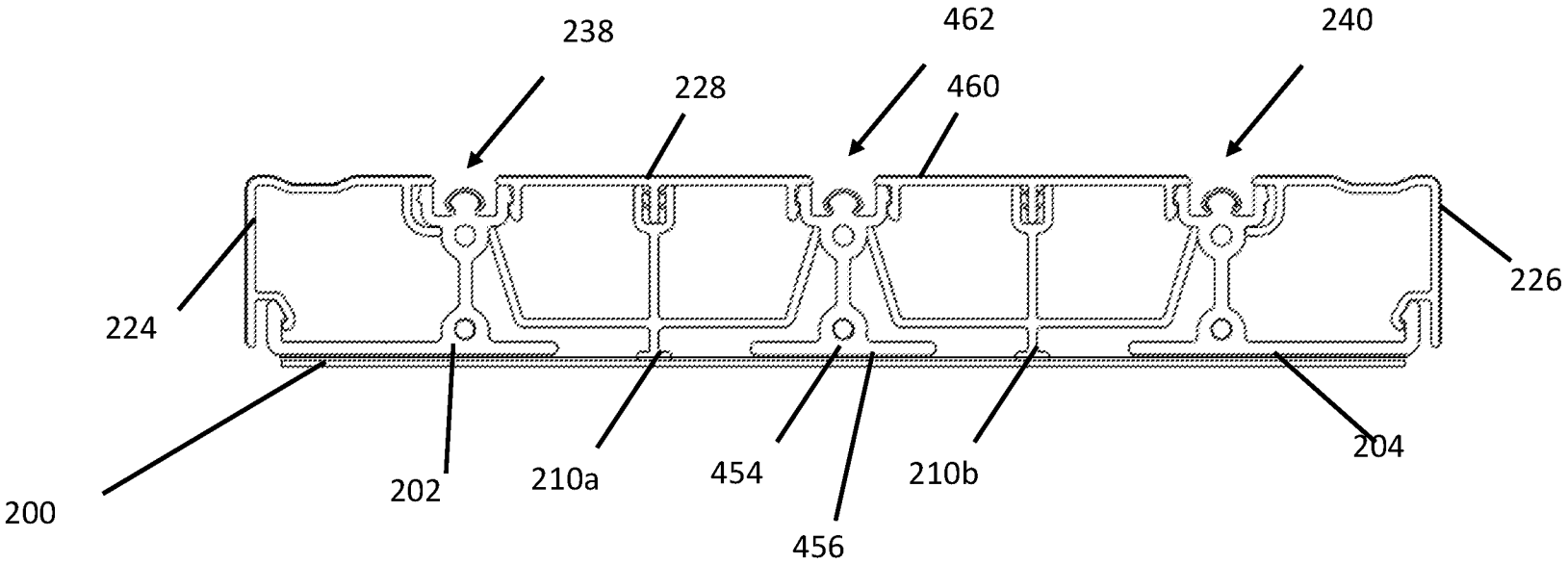
FIG. 4 shows another modular sill system for multiple sliding panels, according to some examples.

By separately forming the first sill frame element 202 and the second sill frame element 204 from one another and the base member 200, a manufacturer can achieve a high degree of customization with relatively interchangeable parts. For example, as shown in FIG. 4, the modular sill system 40 may include any number of additional sill frame elements to provide additional tracks to the modular sill system 40 for supporting any number of panels. As just one example of an advantage associated with the modular sill system arrangements described herein, in comparison to sill systems that are extruded, roll formed, or die-cast, in one step, modular sill systems do not require the expense of buying custom molds for each and every arrangement that is to be manufactured. For example, a base member of a desired width and length may be selected and then the desired number of frame elements affixed or otherwise assembled to the base member.

The frame elements 202, 204 may be attached to the base member 200 in a variety of ways, including using adhesive systems. For example, high bond strength adhesive tape may be used attach the frame elements (e.g., frame elements 202, 204) to the base member 200. This attachment methodology can be particularly efficient from an assembly stand point, while also providing a reliable and durable modular sill system 40. As shown, the modular sill system 40 includes a plurality of adhesive members 208 having a width corresponding to the first and second frame elements 202, 204 and which are configured to adhere the first sill frame element 202 and the second sill frame element 204 to the base member 200. For example, the adhesive members 208 may be a double-sided, adhesive tape material with a high bond adhesive and durable carrier (e.g., such as the double-sided adhesive tape sold under the trade name "VHB" by 3M Company).

The base member 208 may be formed as an elongate, relatively planar and thin section of material. For example, the base member may be formed as a plate, or sheet of durable metal, such as stainless steel (although composites and other materials are contemplated). As shown, a top surface of the base member 208 is substantially planar, although designs with steps, channels, projections or other features are contemplated.

As shown in FIG. 2, the modular sill system 40 may also include one or more support members 210 configured to contact the base member 200. As shown in FIG. 2, the support member 210 may reside in the space between sill frame elements 202, 204 and may be secured in place by a friction fit (e.g., mechanical snap fit and/or other mechanism). In certain instances, each of the support member(s) 210 includes arms 212, 214 that extend outwardly from a base 216 of the support member 210 and which engage the sill frame elements 202, 204. As shown, each of the support member(s) 210 includes a vertical support 218 that extends from base 216 of the support member 210. The support member(s) 210 are generally disposed at selected locations along the base member 208 between the frame elements 202, 204 and may work to help support cover components or other features of the modular sill system 40, which are described below. The support member(s) 210 can help dampen any noise otherwise generated by the cover components, for example.

As shown, the modular sill system 40 includes cover components 224, 226, 228 that are coupled to one or more of the first sill frame element 202, the second sill frame element 204, and the support member 210. In terms of function and configuration, the cover components 224, 226, 228 conceal spaces between the first sill frame element 202, the second sill frame element 204, the support member 210 and the base member 200.

As shown, the first cover component 224 is a side cover attached to features of the first sill frame element 202. In turn, the second cover component 226 is an intermediate cover component secured between the first and second sill frame elements 202, 204, as well as the support member(s) 210. The third cover component 228 is another side cover attached to features of the second sill frame element 204. The cover components 224, 226, 228 are releasably coupled to the first sill frame element 202, the second sill frame element 204, and the support member 210 (as applicable).

The at least one cover component 224, 226, 228 may be snap-fit together with the first sill frame element 202, the second sill frame element 204, and/or the support member 210. As shown, the first sill frame element 202 and the second sill frame element 204 may include arms 230, 232 that extend vertically relative to horizontal portions 234, 236 of the first sill frame element 202 and the second sill frame element 204. The horizontal portions 234, 236 of the first sill frame element 202 and the second sill frame element 204 may be adhered to the base member 200.

In certain instances, the first cover component 224 may snap-fit with the arm 230 of the first sill frame element 202, and the second cover component 226 may snap-fit with the arm 232 of the second sill frame element 204, and the third cover component 228 may snap-fit with vertical supports 220, 222 of the first sill frame element 202 and the second sill frame element 204. Although the cover components 224, 226, 228 may each be formed as a single elongate structure, the cover components 224, 226, 228 can also include separate and connected components as desired.

Toward the top of the vertical supports 220, 222, each of the sill frame elements 202, 204 defines tracks 238, 240. The tracks 238, 240 are configured to receive a first and second panel respectively such that the panels are capable of sliding over the tracks 238, 240. For reference, although the term "sliding" is used with regard the movement of the panel, it should be understood that rollers, wheels, and other mechanisms are employed to achieve the "sliding" movement as desired. For example, a roller or rider is arranged on the bottom of a panel, or as a portion of the panel, that is received in the track 238, 240 and rides along the sill frame elements 202, 204. Thus, the term "sliding" is to be read inclusive of "rolling" in the sense of panel movement. Generally, the cover components 224, 226, 228 are arranged to cover the gaps between and around the first and second sill frame elements 202, 204 while leaving the tracks 238, 240 operatively exposed to the respective panels. As shown, the cover components 224, 226, 228 collectively form a substantially planar surface which may provide a more sleek appearance and facilitate crossing over the threshold defined by the modular sill system 40 (e.g., for walking entry or for wheelchair access). Additionally, the ability to remove the cover components 224, 226, 228 can facilitate cleaning, repair, and maintenance of the modular sill system 40.

Figure 3:
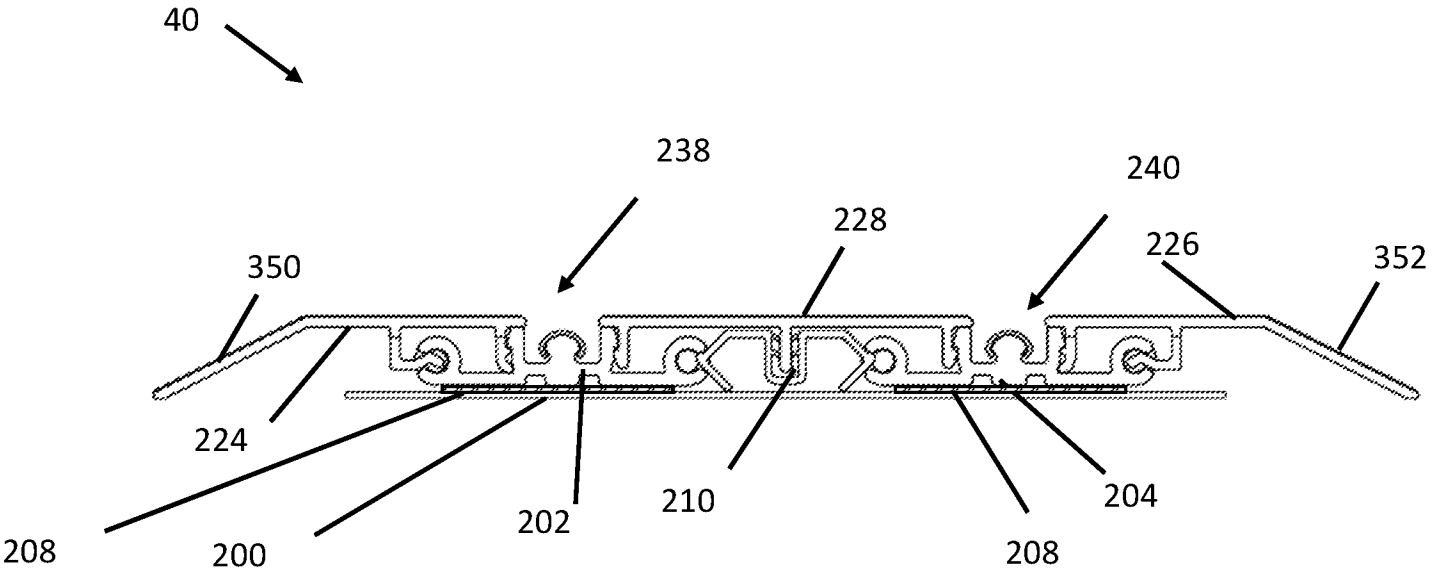
FIG. 3 shows another modular sill system for multiple sliding panels, according to some examples.

FIG. 3 shows another example modular sill system 40 for multiple sliding panels, according to some examples. The example of FIG. 3 is a lower profile version of the example of FIG. 2, which may have further advantages such as enhanced accessibility (e.g., for the elderly, wheelchair users, or in instances where lower profile thresholds are desirable). The modular sill system 40 is shown in a cross-sectional view. The modular sill system 40 includes a base member 200, a first sill frame element 202 affixed to the base member 200, and a second sill frame element 204 affixed to the base member 200. Similar to the system 40 shown in FIG. 2, the first sill frame element 202 and the second sill frame element 204 are distinct and separate components.

As with other examples, the sill frame elements 202, 204 may be adhered to the base member 200 (e.g., using adhesive tape 208 configured to adhere the first sill frame element 202 and the second sill frame element 204 to the base member 200). Similarly to the example of FIG. 2, the modular sill system 40 of FIG. 3 may also include a support member 210 configured to contact the base member 200 that is arranged between the first sill frame element 202 and the second sill frame element 204. The components may be coupled together as described above with reference to FIG. 2.

The modular sill system 40 of FIG. 3 also includes cover components 224, 226, 228 with similar functions to those described in association with the example of FIG. 2. As shown in FIG. 4, in certain instances, the modular sill system 40, and in particular the cover components 224, 226, may form a ramp structure to accommodate handicap accessible systems. As compared to a non-ramped system shown in FIG. 2, the first sill frame element 202 and the second sill frame element 204 of FIG. 3 may be lower profile overall with relatively less height. And, as shown, at least one of the first cover component 224 and the second cover component 226 can include angled portion 350, 352 between the substantially planar surface of the cover components 224, 226, 228 and the base member 200. As shown, the angled portions 350, 352 create a ramp structure for crossing the modular sill system 40 of FIG. 3.

FIG. 4 shows still another example modular sill system 40 for multiple sliding panels, according to some examples. The modular sill system 40 is shown in a cross-sectional view and is generally similar to the example of FIG. 2, with the addition of another sill frame element. As shown, the modular sill system 40 includes a base member 200, a first sill frame element 202 affixed to the base member 200, a second sill frame element 204 affixed to the base member 200, and a third sill frame element 454. The third sill frame element 454 may be of different construction than the first sill frame element 202 and the second sill frame element 204 (e.g., due to the fact that side covers need not be attached to the third sill frame element 454). The third sill frame element 454 is generally an intermediate sill frame element, positioned between two side sill frame elements—the first sill frame element 202 and the second sill frame element 204. If additional panels are to be utilized, a base member having a greater width can be employed and additional intermediate sill frame members similar to the third sill frame element 454 may be employed as desired.

In different terms, as shown in FIG. 4, the first sill frame element 202 and the second sill frame element 204 may be configured for being placed on ends of the base member 200, whereas the third sill frame element 454 may be arranged within a middle portion of the base member 200. In instances where sill frame elements in addition to the third sill frame element 454 are used in a modular sill system 40, the modular sill system 40 can include the first sill frame element 202 and the second sill frame element 204 arranged on ends of the base member 200 and any number of third sill frame elements 454 arranged therebetween. The third sill frame element 454 may include a central horizontal portion 456 that is coupled or attached to the base member as discussed in further detail with reference to FIG. 5.

Similar to the system 40 shown in FIG. 2, the first sill frame element 202, the second sill frame element 204, and the third sill frame element 454 are distinct and separate components and each of the sill frame elements 202, 204, 454 may be affixed to the base member 200 in manners similar to those previously described.

The modular sill system 40 may also include support members 210*a*, 210*b* configured to contact the base member 200 and arranged to support the cover component 224, 226, 228, 462. The support members 210*a*, 210*b* may include the same structure as the support members 210 as described with reference to FIG. 2 and may be utilized in the same manner as previously described.

Similar to the previous examples, the modular sill system 40 also cover component 224, 226, 228, 462 that is coupled (e.g., snap-fit) to the sill frame elements 202, 204, 454 and the support members 210*a*, 210*b*. In addition, the at least one cover component 224, 226, 228, 462 is configured to conceal spaces between the sill frame elements 202, 204, 454, the support members 210, 210*b* and the base member 200. As shown, an upper surface of the cover components 224, 226, 228 may be substantially planar. In addition, the cover components 224, 226, 228, 462 may include a first cover component 224 coupled to the first sill frame element 202, a second cover component 226 coupled to the second sill frame element 204, a third cover component 228 coupled to the first sill frame element 202 and the third sill frame element 454, and a fourth cover component 460 coupled to the second sill frame element 204 and the third sill frame element 454. Additional cover components (and support members) may be added for each additional third (intermediate, or central) sill frame element 454.

Similar to previous examples, each of the sill frame elements 202, 204,454 include tracks 238, 240, 462 that are configured to receive panels, respectively. In certain instances, the cover components 224, 226, 228, 460 are arranged to allow for gaps between the cover components 224, 226, 228, 460 such that the tracks 238, 240, 462 remain exposed.

Figure 5:
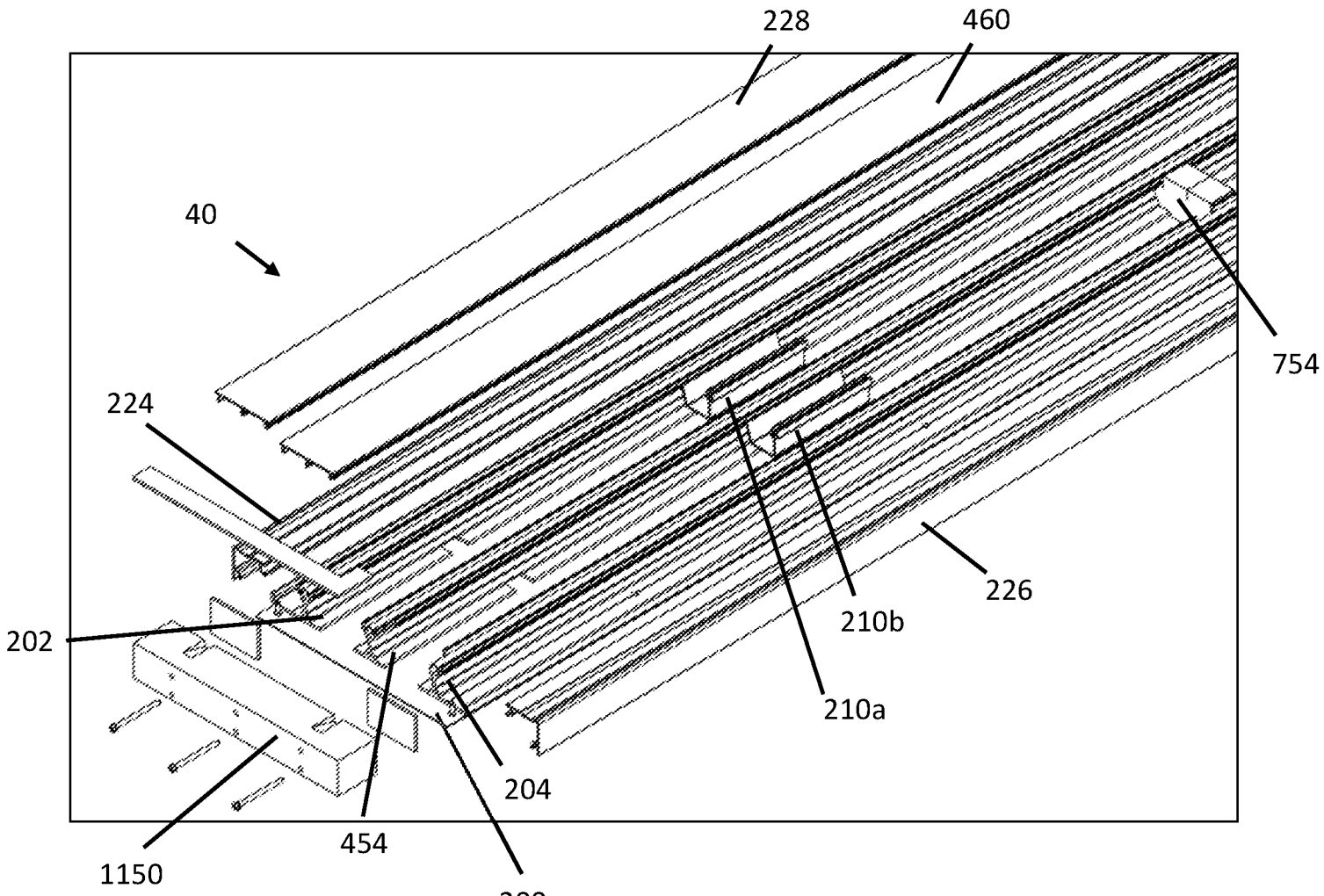
FIGS. 5 and 6 are unassembled views of the system of FIG. 4 according to some examples.
Figures 6, 7:
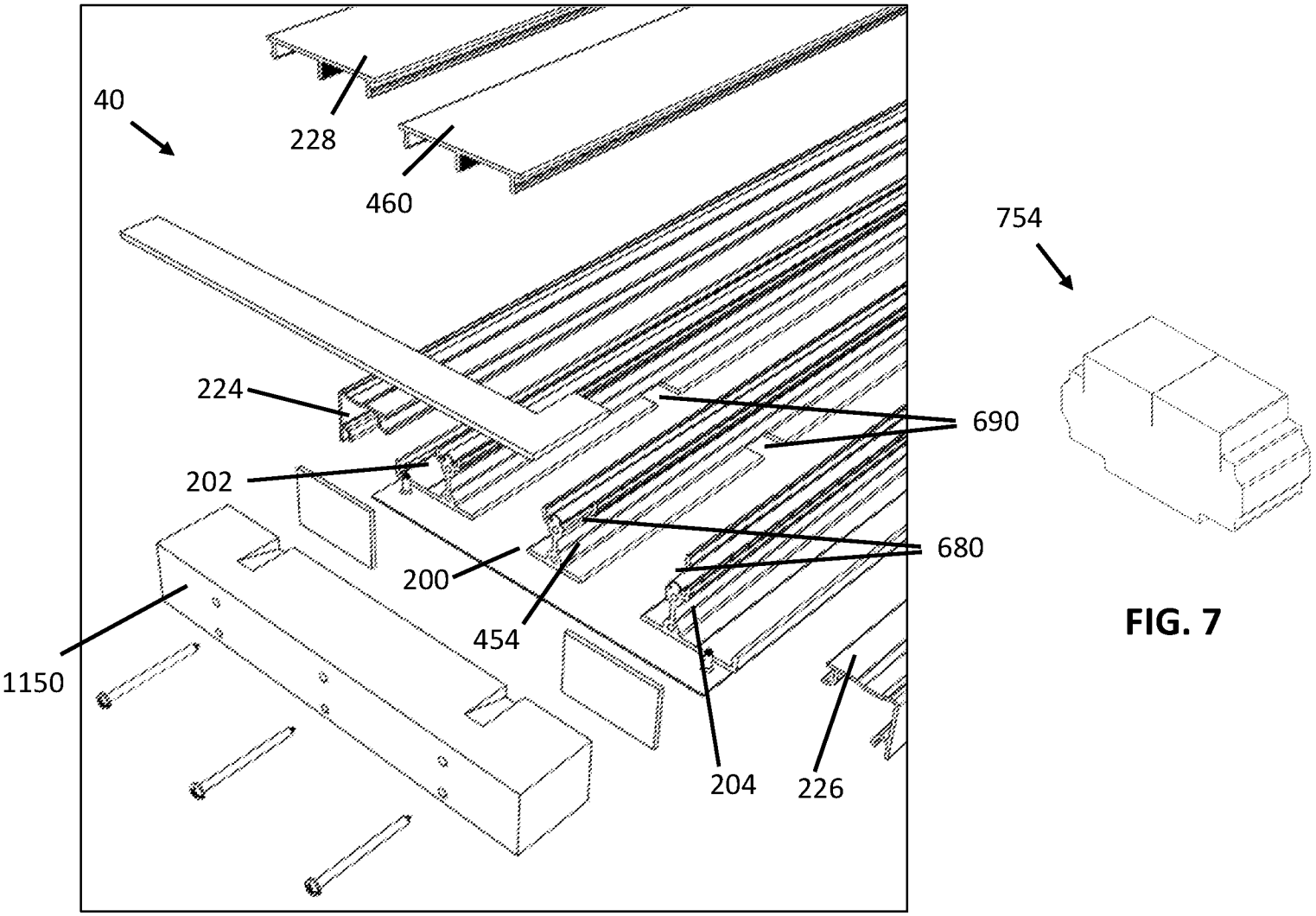
FIG. 7 shows a sill plug of a modular sill system, according to some examples.

FIG. 5 shows a perspective view of the example modular sill system 40 of FIG. 4. in an unassembled state, according to some examples. FIG. 6 is an enlarged view of a portion of FIG. 4. As shown, the support members 210*a*, 210*b* are segmented and disposed intermittently along the length of the base member 200. In different terms, the sill frame elements 202, 204 454 are arranged across a length of the system 40, and a plurality of the support members 210*a*, 210*b* are arranged over a portion of a length of the system 40. The modular sill system 40 also includes at least one cover component 224, 226, 228, 462 that is coupled (e.g., snap-fit) to the sill frame elements 202, 204, 454 and the support members 210*a*, 210*b*. In addition, the at least one cover component 224, 226, 228, 462 is configured to conceal spaces between the sill frame elements 202, 204, 454, the support members 210*a*, 210*b* and the base member 200. The modular sill system 40 also includes sill plugs 754, an example of which is shown in greater detail in the isometric view of FIG. 7. The sill plugs 754 are arranged within one or more of the spaces defined between the sill frame elements. The sill plugs 754 create water-barriers to limit water migration within the modular sill system 40 along the length of the base member 200. As shown, the modular sill system 40 may also include end caps 1150 fastened to ends of base member 200 to assist with assembly of the modular sill system 40.

Figure 8:
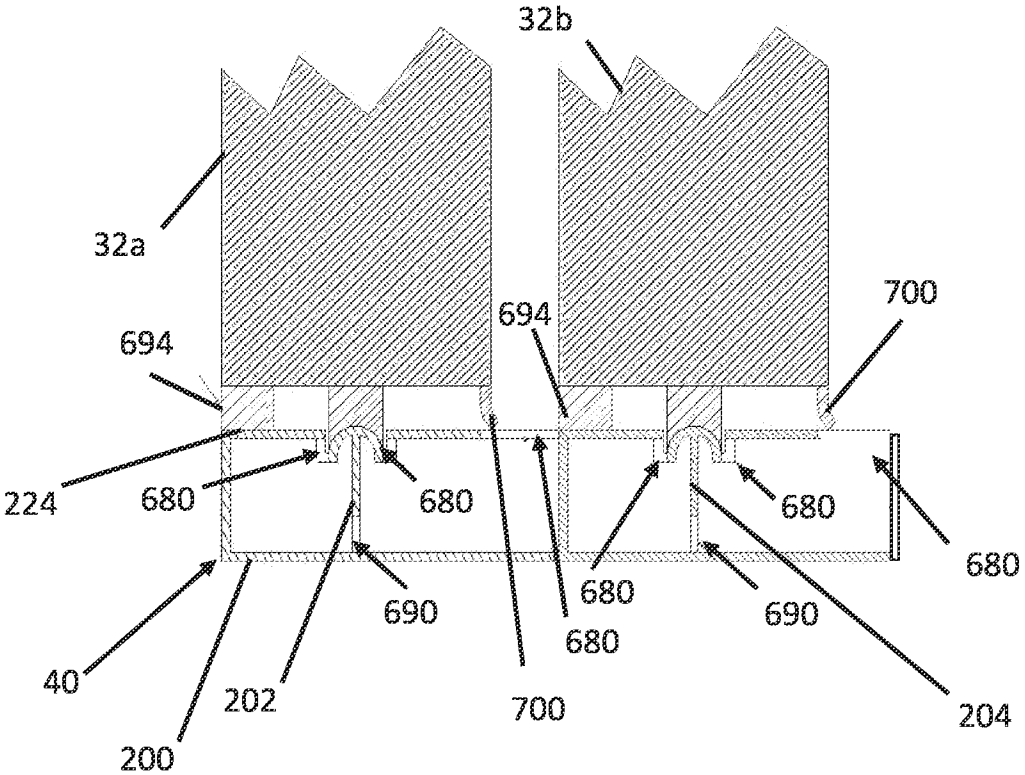
FIG. 8 is a schematic view of weather management features of modular sill systems, according to some examples.

FIG. 8 is a schematic showing pressure equalization features for the examples of the modular sill systems 40, according to some examples. As shown, vent panels 32*a*, 32*b* are positioned on first sill frame element 202 affixed to the base member 200 and a second sill frame element 204 affixed to the base member 200. As discussed in detail above, in various examples the modular sill system 40 includes cover component(s) coupled to the sill frame elements. The cover component(s) 224 conceal spaces between the sill frame elements and the base member 200. One or more apertures 680 are formed through the tracks defined by the sill frame elements and/or through the cover component(s) 224 adjacent the tracks defined by the sill frame elements 202, 204. The apertures 680 permit air flow for pressure equalization during weather events and also permit water to flow into the spaces under the cover component(s) 224 for drainage onto the base member 200. The modular sill system 40 also includes weep holes 690 provide air flow for pressure equalization in certain instances as well as drainage pathways for water between the spaces. In this manner, the pressure drop across the water seals 700 at the front edges of the panels 32*a*, 32*b* is reduced to help reduce water ingress under the panels due to positive pressure. In turn, the air seals 694 on the back edge of the panels 32*a*, 32*b* help prevent water and air from flowing past the panels 32*a*, 32*b* into the building structure. Similar seals and pressure equalization techniques may be used in each of the examples previously described. For additional examples of apertures 680 and weep holes 690, see FIG. 6.

Figure 9:
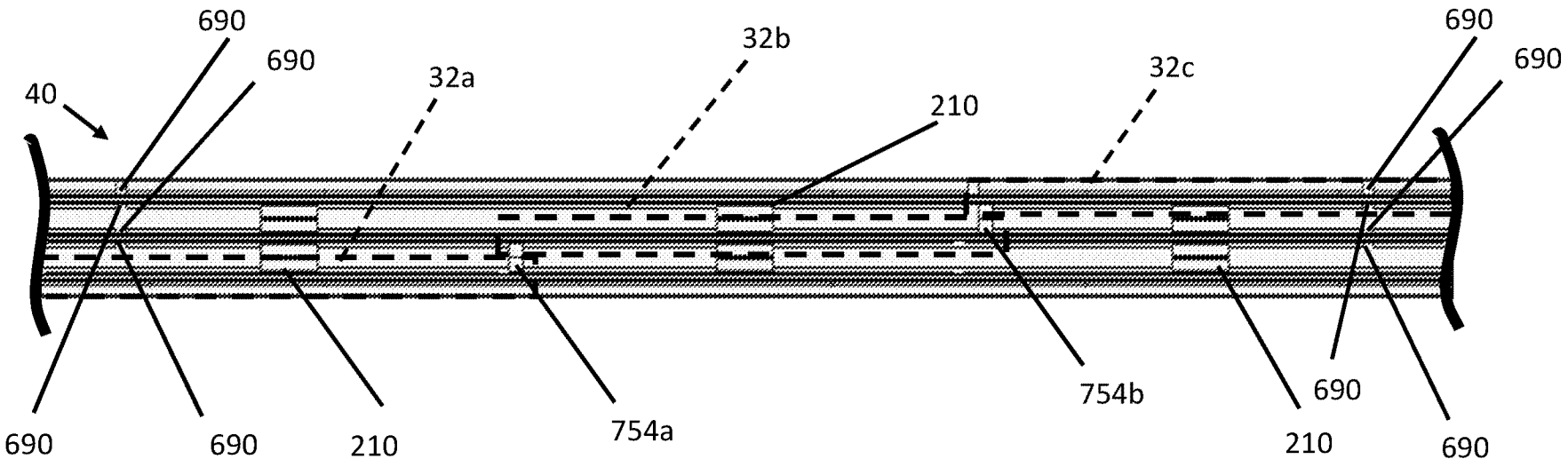
FIGS. 9 and 10 are illustrative of various sill plug and weep hole positions of modular sill systems, according to some examples.

FIG. 9 shows a top view of a modular sill system 40 for supporting one or more sliding panels, according to some examples. Although cover component(s) would typically be present, they are removed for visualization purposes in FIG. 9. Similar to previous examples, the modular sill system 40 includes a plurality of sill frame elements that form a plurality of tracks extending between a first end 750 and a second end 752 of the base member 200. FIG. 9 is provided to help visualize the position of sill plugs 754 in the modular sill system 40, according to various examples. As indicated in FIG. 9, the modular sill system 40 includes a plurality of sill plugs 754, similar to that shown in FIG. 7, for example. The sill plugs 754*a*, 754*b* are arranged within the spaces defined between the sill frame element(s) (see FIG. 5 for an example of this positioning). In certain instances, each of the sill plugs 754*a*, 754*b* creates a water-barrier to limit water migration within the modular sill system 40 along a length of the base member 200. The sill plugs 754*a*, 754*b* are shown at positions that would correspond to the position of the vertical edges of sliding panels 32*a*, 32*b*, 32*c* when they are in a closed position on the modular sill system 40. In general terms, each of the sill plugs 754 is a section of material having a profile that corresponds to the shape of the spaces between the track frame(s) and web(s). In this manner, the sill plugs 754 act as a barrier or wall that stops water from flowing underneath the panel edge under which it is positioned.

Figure 10:
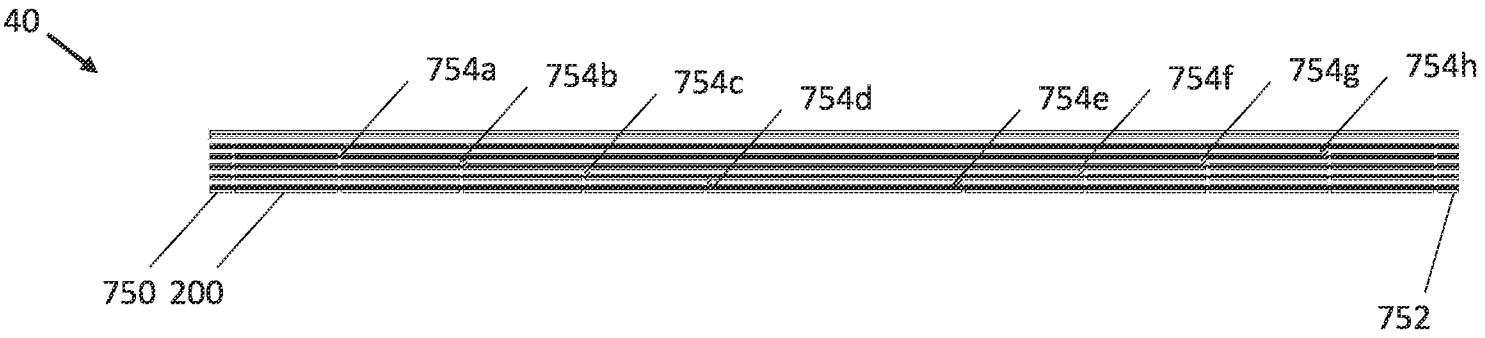

FIG. 10 shows another example of sill plug positioning according to various examples. As shown in FIG. 10, sill plugs 754*a-h* are located at positions corresponding to the edges of closed panels (not shown) associated with the modular sill system 40 of FIG. 10 (the example of FIG. 10 could be used for 9 sliding panels meeting at the middle of the modular sill system 40 of FIG. 10.

Figures 11A, 11B, 11C:
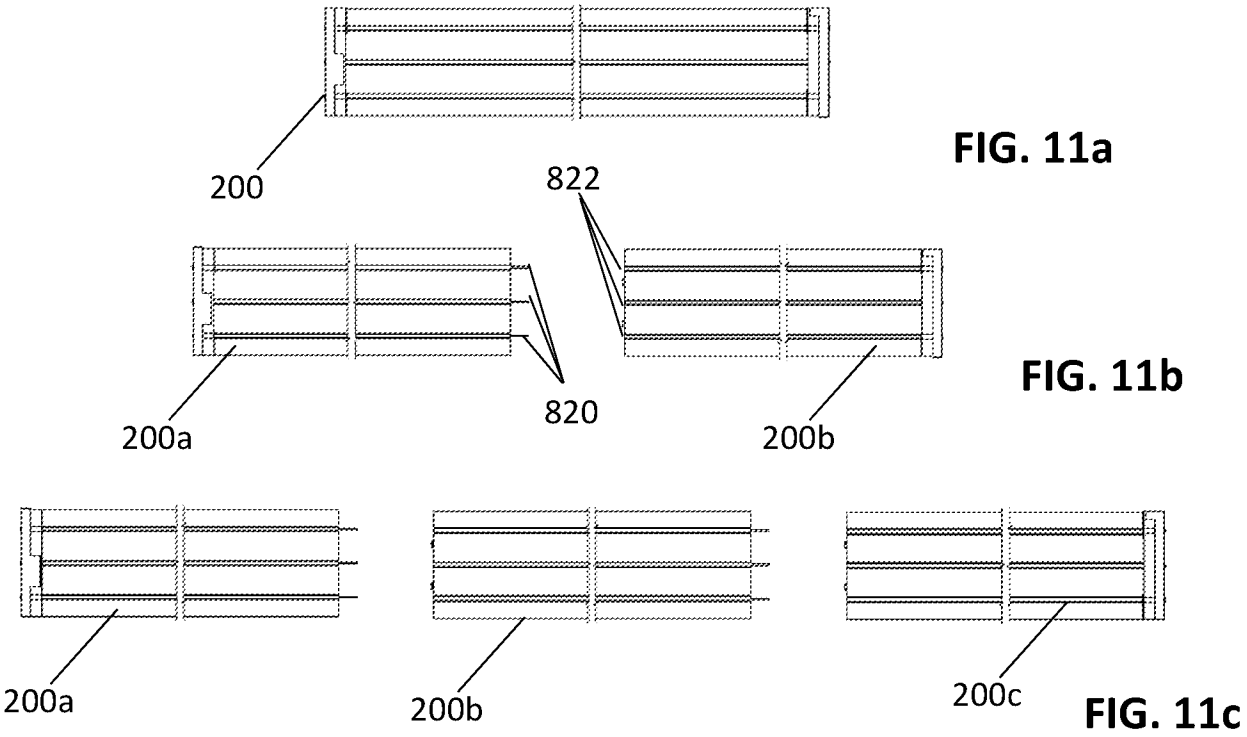

FIGS. 11*a* to 11*c* show examples of a sill system with different segmentations. FIG. 11*a* shows a constant length sill system 40 and in particular base member 200. FIG. 11*b* shows a multi-section sill system 40 and base member 200 with a base member and associated components of the sill system 40 divided into two sections. FIG. 11*c* shows a multi-section sill system 40 with three sections. Thus, as shown in FIG. 11*b* and FIG. 11*c*, the sill system 40 may be divided into multiple sections 40*a*, 40*b*, and/or 40*c* for assembly on site. To connect sections 40*a*, 40*b*, and/or 40*c* of the base member 200, adjacent ones of the sections 40*a*, 40*b*, and/or 40*c* include a male connector 820 and a female connector 822, respectively, as shown in further detail in FIG. 12.

Figure 12:
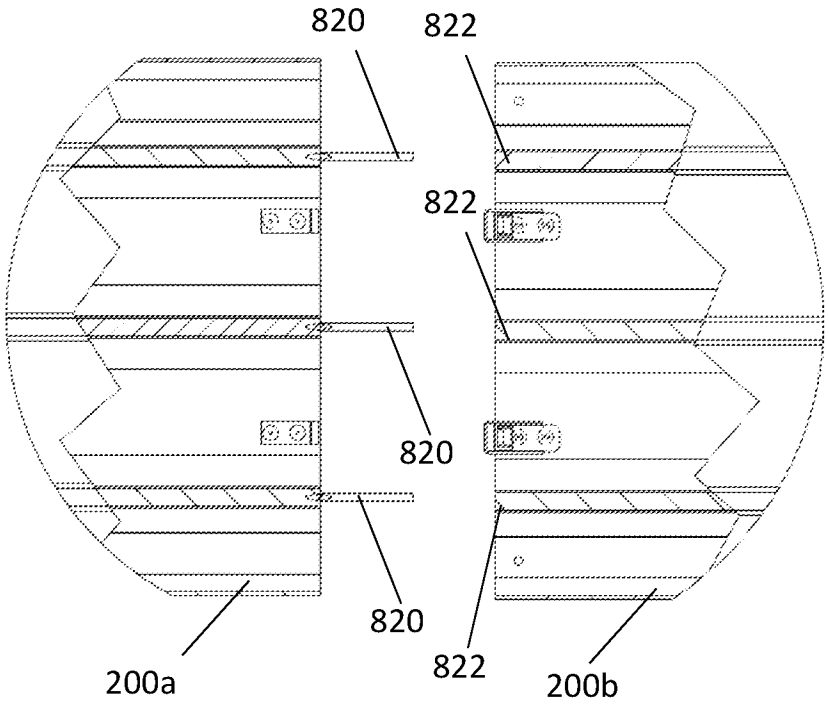

FIG. 12 shows a close-up view of one of the connections between sections of the modular sill system 40, according to some examples. As shown, the male connector 820 includes a pin or similar feature and the female connector 822 includes a receptacle or slot for receiving the male connector 820. The male and female connectors 820, 822 help align panel sections to facilitate assembly. Thus, a method of assembling the modular sill system 40 includes aligning the base sections using the male and female connectors and securing the base sections together.

Figure 13:
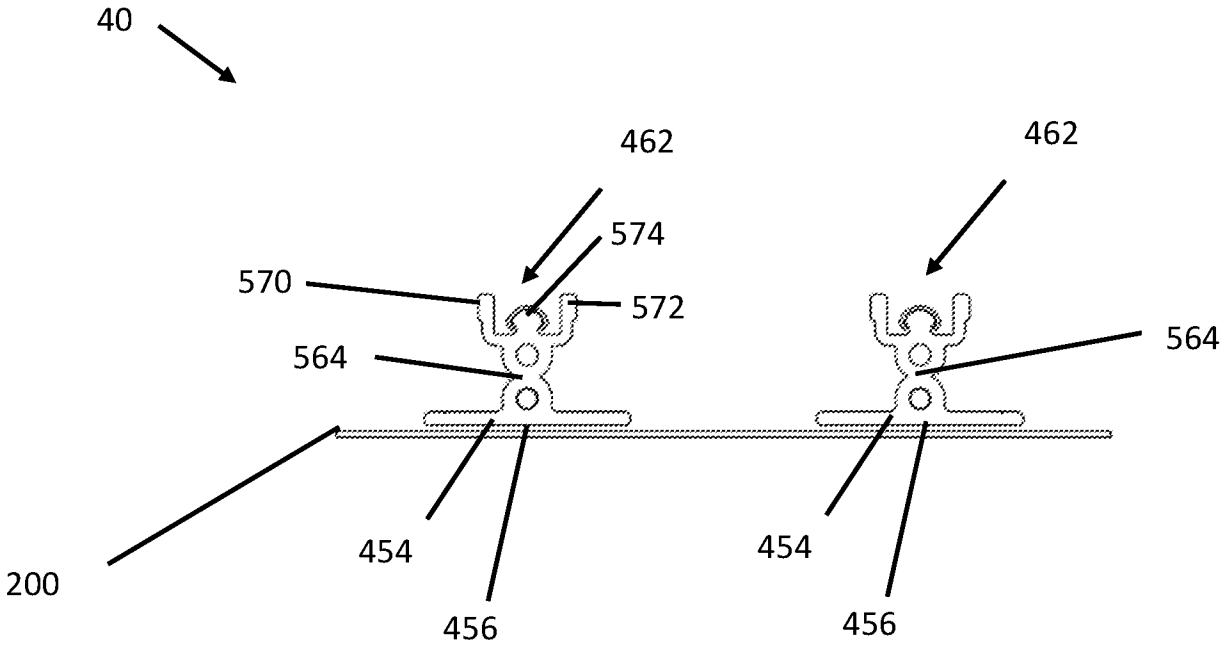
FIG. 13 shows a sectional illustration of another modular sill system for multiple sliding panels, according to some examples.

FIG. 13 shows another example sill frame elements 454 for a modular sill system for multiple sliding panels, according to some examples. The sill frame elements 454 shown in FIG. 13 may be central sill frame elements 454, similar to the third sill frame element 454 of FIG. 4, and which are arranged centrally within a modular sill system 400. The central sill frame elements 454 of FIG. 13 can include a central horizontal portion 456 that is affixed (e.g., adhered) to the base member 200. A height of the central sill frame elements 454 may be adjusted by adding length to an intermediate portion 564 of the central sill frame elements 454.

As shown in FIG. 13, and similar to the other examples of sill elements described above, the central sill frame elements 454 include arms 570, 572 and a rail projection 574 that support a panel (e.g., rollers or wheels on the panel) that slides along the track 462 of the frame track element 454. With the example of FIG. 13, the modular sill system 40 can be installed into a floor to provide a flush, recessed assembly. For example, cement, tile, mortar, or other material may be disposed on top of the base member 200 and between the sill frame elements 454 to provide a clean, low-profile assembly in which only the arms 570, 572 and rail projections 574 are exposed. In this example, the weather system features (e.g., apertures, weep holes, and sill plugs) are not applicable as there is no space defined by the modular sill system 43 in which to perform the weather management function.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. A modular sill system for multiple sliding panels, the system comprising:

a base member having a first end and a second end;

a first sill frame element affixed to the base member including a first horizontal portion coupled to the base member and a track spaced from the first horizonal portion and configured to receive a panel and to support the panel for sliding motion;

a second sill frame element, distinct from first sill frame element, affixed to the base member, the second sill frame element including a second horizontal portion coupled to the base member and a track spaced from the second horizontal portion and configured to receive a panel and to support the panel for sliding motion;

a support member extending from the base member and arranged between the first sill frame element and the second sill frame element; and at least one cover component coupled to the first sill frame element and the second sill frame element that is configured to conceal a space between the first sill frame element and the second sill frame element.

2. The system of claim 1, further comprising an adhesive tape adhering the first sill frame element to the base member.

3. The system of claim 1, wherein a top surface of the base member is substantially planar from an interior edge to an exterior edge of the base member.

4. The system of claim 1, wherein the base member includes stainless steel material.

5. The system of claim 1, wherein the at least one cover component is releasably coupled to the first sill frame element.

6. The system of claim 5, wherein the at least one cover component and the first sill frame element are snap-fit together.

7. The system of claim 1, wherein the at least one cover component includes a first cover component coupled to the first sill frame element, a second cover component coupled to the second sill frame element, and a third cover component coupled to the first sill frame element and the second sill frame element.

8. The system of claim 7, wherein the track of the first sill frame element comprises a first track configured to receive a first panel and the track of the second sill frame element comprises a second track configured to receive a second panel, and the first cover component, the second cover component, and the third cover component form a substantially planar surface with gaps for the first track and the second track.

9. The system of claim 8, wherein at least one of the first cover component and the second cover component includes an angled portion forming a ramp feature.

10. A fenestration unit including a modular sill system for multiple sliding panels, the fenestration unit comprising:

a first sliding panel and a second sliding panel;

a base member having a first end and a second end, an interior edge and an exterior edge, and a top surface that is substantially planar from the interior edge to the exterior edge of the base member;

a first sill frame element including a first portion affixed to the base member between the interior edge and the exterior edge and a track spaced from the first portion upon which the first sliding panel slides;

a second sill frame element, distinct from first sill frame element, including a second portion affixed to the base member between the interior edge and the exterior edge and a track spaced from the second portion upon which the second sliding panel slides;

a cover component releasably coupled to the first sill frame element and the second sill frame element to cover a space between the first sill frame element, the second sill frame element and the base member, and a support member disposed with the space and extending from the base member.

11. The fenestration unit of claim 10, wherein the modular sill system includes one or more apertures adjacent the track of the first sill frame element, the one or more apertures providing an air pathway into the space between the first sill frame element, the second sill frame element and the base member.

12. The fenestration unit of claim 10, further comprising a sill plug arranged in the space between the first sill frame element, the second sill frame element and the base member.

13. A method of manufacturing a modular sill system for multiple sliding panels, the method comprising:

affixing a first portion of a first sill frame element to a base member between an interior edge and an exterior edge of the base member, wherein the first sill frame element includes a track spaced from the first portion and configured to receive a panel and to support the panel for sliding motion;

affixing a second portion of a second sill frame element, distinct from first sill frame element, to the base member between the interior edge and the exterior edge of the base member, wherein the second sill frame element includes a track spaced from the second portion and configured to receive a panel and to support the panel for sliding motion;

arranging a support member, distinct from the first sill frame element, in contact with the base member and between the first sill frame element and the second sill frame element; and coupling a cover component to the first sill frame element and the second sill frame element.

14. The method of claim 13, wherein affixing the first sill frame element to the base member includes adhering the first sill frame element to the base member using an adhesive tape on the base member.

15. The method of claim 13, wherein affixing the second sill frame element to the base member includes adhering the second sill frame element to the base member using an adhesive tape on the base member.

16. A modular sill system for multiple sliding panels, the system comprising:

a base member having a first end and a second end;

a first sill frame element affixed to the base member;

a second sill frame element, distinct from first sill frame element, affixed to the base member;

a support member extending from the base member and arranged between the first sill frame element and the second sill frame element; and at least one cover component coupled to the first sill frame element and the second sill frame element that is configured to conceal a space between the first sill frame element and the second sill frame element, wherein the first sill frame element forms a first track configured to receive a first panel and the second sill frame element forms a second track configured to receive a second panel.

17. The system of claim 16, wherein the at least one cover component includes a first cover component coupled to the first sill frame element, a second cover component coupled to the second sill frame element, and a third cover component coupled to the first sill frame element and the second sill frame element.

18. The system of claim 17, wherein the first cover component, the second cover component, and the third cover component form a substantially planar surface with gaps for the first track and the second track.

19. The system of claim 1, wherein the first sill frame element includes a first vertical support extending from the first sill frame element between an interior edge and an exterior edge of the first sill frame element and defining the track of the first sill frame element, and wherein the second sill frame element includes a second vertical support extending from the second sill frame element between an interior edge and an exterior edge of the second sill frame element and defining the track of the second sill frame element.

20. The system of claim 1, wherein the support member is coupled to the first and second sill frame elements.

21. The system of claim 20, wherein the support member is coupled to the first and second sill frame elements via a mechanical, friction, or snap fit.

22. The system of claim 1, wherein the support member is coupled to the at least one cover component.

23. The system of claim 1, wherein the modular sill system is symmetrical about central plane extending between a first and second end of the modular sill system.

* * * * *